US005979520A

United States Patent [19]

Behrendt

[11] Patent Number: 5,979,520

[45] Date of Patent: Nov. 9, 1999

[54] DEVICE FOR SMOOTHING PANELS OR BATTENS

[75] Inventor: Burkhard Behrendt, Bad Hersfeld, Germany

[73] Assignee: Babcock-BSH GmbH, Bad Hersfeld, Germany

[21] Appl. No.: 09/051,731

[22] PCT Filed: Oct. 30, 1996

[86] PCT No.: PCT/EP96/04714

§ 371 Date: Apr. 17, 1998

§ 102(e) Date: Apr. 17, 1998

[87] PCT Pub. No.: WO97/17179

PCT Pub. Date: May 15, 1997

[30] Foreign Application Priority Data

Nov. 3, 1995 [DE] Germany ..... 195 41 000

[51] Int. Cl.[6] ..... B27C 1/00

[52] U.S. Cl. ..... 144/114.1; 30/476; 83/672; 144/115; 144/117.1; 144/218; 144/221; 407/12; 407/63; 409/110; 409/124

[58] Field of Search ..... 299/19; 30/169, 30/172, 475, 476, 477; 83/651.1, 663, 672, 680; 144/2.1, 114.1, 115, 117.1, 218, 221, 238, 240; 407/12, 30, 63; 409/131, 132, 110, 124, 293

[56] References Cited

U.S. PATENT DOCUMENTS

| | | | |
|---|---|---|---|
| 10,871 | 5/1854 | Webber | 144/221 |
| 469,845 | 3/1892 | Kussmaul et al. | 144/221 |
| 1,786,096 | 12/1930 | Thielmann | 30/476 |
| 1,939,012 | 12/1933 | Lescalette . | |
| 2,233,998 | 3/1941 | Evjen | 30/476 |
| 3,457,976 | 7/1969 | Andersson et al. | 144/221 |
| 4,077,301 | 3/1978 | Brahm | 409/110 |
| 4,298,555 | 11/1981 | Weltmer . | |
| 4,336,831 | 6/1982 | Mroczkowski | 409/293 |
| 4,936,361 | 6/1990 | Mercier et al. | 144/221 |
| 5,383,275 | 1/1995 | Hild et al. | 30/477 |

FOREIGN PATENT DOCUMENTS

| | | | |
|---|---|---|---|
| 0 456 654 A1 | 1/1992 | European Pat. Off. . | |
| 2 546 806 | 12/1984 | France . | |
| 2 693 399 | 1/1994 | France . | |
| 262338 | 7/1913 | Germany | 144/221 |
| 1 139 425 | 11/1962 | Germany . | |
| 2 207 799 | 9/1972 | Germany . | |
| 22 07 799 | 9/1972 | Germany . | |
| 31 09 387 A1 | 10/1982 | Germany . | |
| 38 01 315 A1 | 7/1989 | Germany . | |
| 295 14 721 U1 | 12/1995 | Germany . | |
| 56751 | 8/1944 | Netherlands . | |
| 1 307 572 | 2/1973 | United Kingdom . | |

*Primary Examiner*—W. Donald Bray
*Attorney, Agent, or Firm*—Herbert Dubno; Andrew Wilford

[57] ABSTRACT

An apparatus for smoothing a workpiece has a housing that is displaced relative to the workpiece in a direction and that carries a pair of augers provided with respective screwthreads having outer edges in contact with the workpiece. These augers are rotated on the housing about respective generally parallel axes transverse to the direction so as to scrape the workpiece with the screwthreads. Furthermore the augers are of such a hand and the are rotated in such a direction that the augers exert on the workpiece opposite axially directed forces.

20 Claims, 10 Drawing Sheets

DEVICE FOR SMOOTHING PANELS OR BATTENS

CROSS REFERENCE TO RELATED APPLICATIONS

This is the U.S. national phase of PCT application PCT/EP96/04714 filed Oct. 30, 1996 with a claim to the priority of German application 195 41 000.9 filed Nov. 3, 1995.

FIELD OF THE INVENTION

The inventions relates to an apparatus for smoothing continuous panels or strips, in particular gypsum-fiber panels and the like. More particularly this invention concerns a system for smoothing panels as they are produced continuously and to a portable hand tool used for smoothing elongated workpieces.

BACKGROUND OF THE INVENTION

European 0,465,654 describes an apparatus for leveling concrete floors or the like. A rail-mounted carriage carries a horizontal and rotationally driven auger. During translatory movement of the carriage in a direction perpendicular to the axis of the auger, the rotating auger smooths unhardened concrete.

An apparatus described in U.S. Pat. No. 4,298,555 works similarly. This apparatus serves for smoothing the inner surfaces of conical concrete floors of tanks or the like. An auger rotationally driven about its axis is movable in a frame which moves around the axis of the cone, inclined at the cone's apex angle, so that, as it orbits the frame, the entire inner surface of the cone is rotationally passed over to smooth the still plastic concrete.

OBJECT OF THE INVENTION

It is an object of the invention to provide an apparatus of the type described wherein clogging of the tool is avoided, wear is minimized, and little dust is generated; in addition it is an object of the invention to provide a portable hand tool for smoothing strips. It is also within the scope of the objects to integrate the apparatus so into a production line for gypsum-fiber panels that it works wholly without generating dust.

BRIEF DESCRIPTION OF THE DRAWING

The drawing serves for explaining the invention with reference to simplified and schematically illustrated embodiments. Therein

SPECFIC DESCRIPTION

Figure 1:
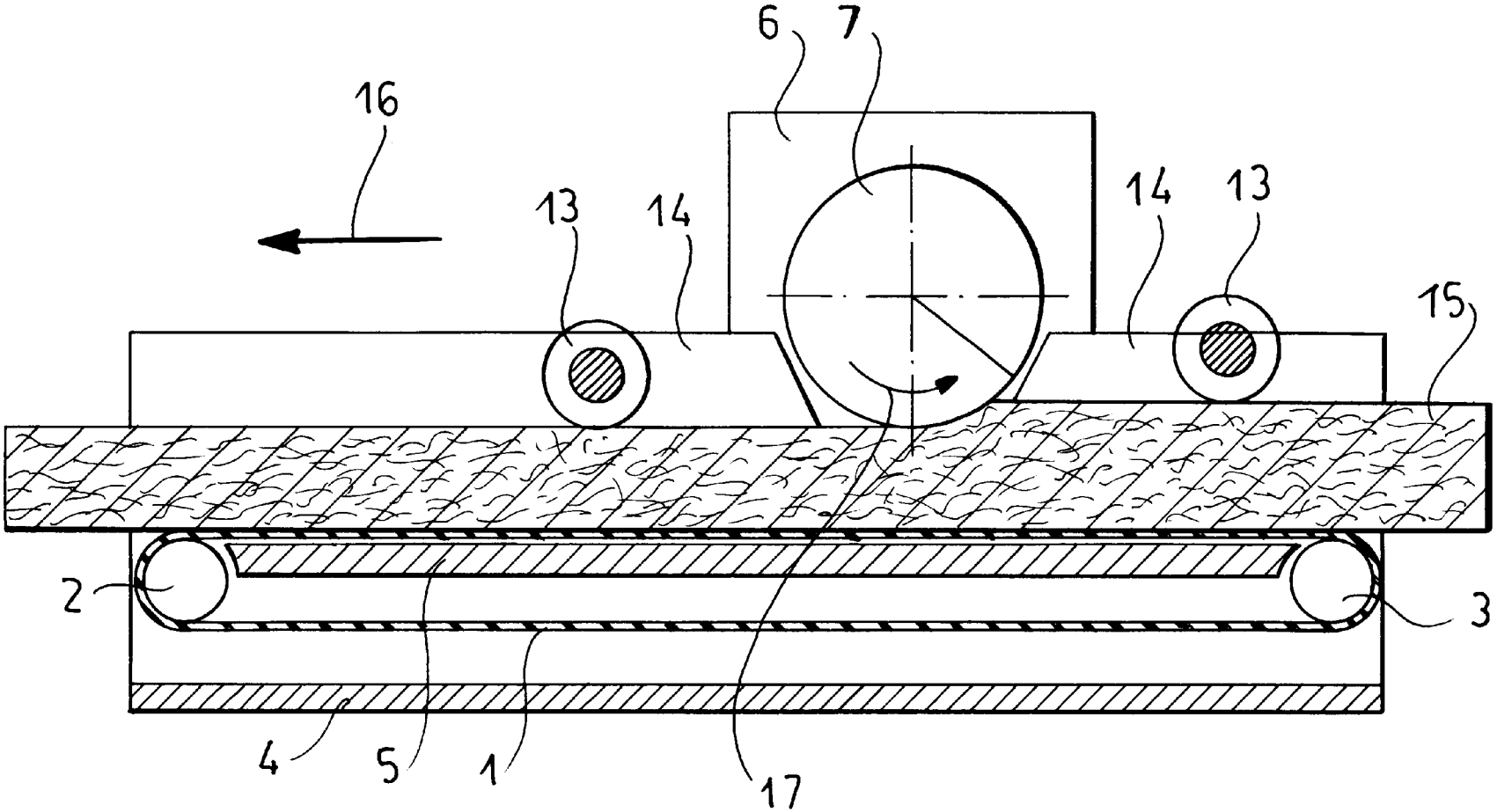
FIG. 1 is a side view of an apparatus according to the invention.
Figure 2:
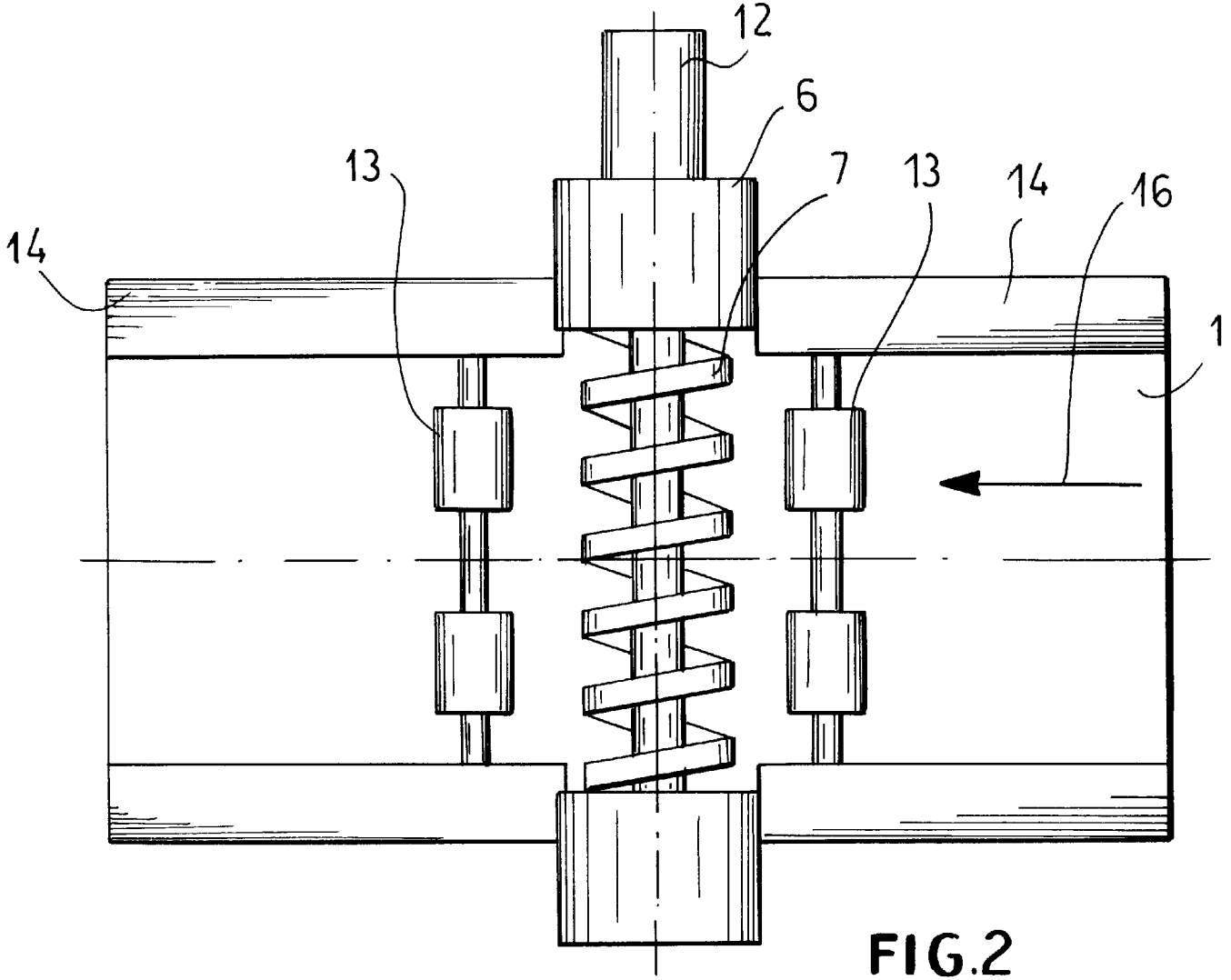
FIG. 2 is a top view of the apparatus according to FIG. 1.
Figure 5:
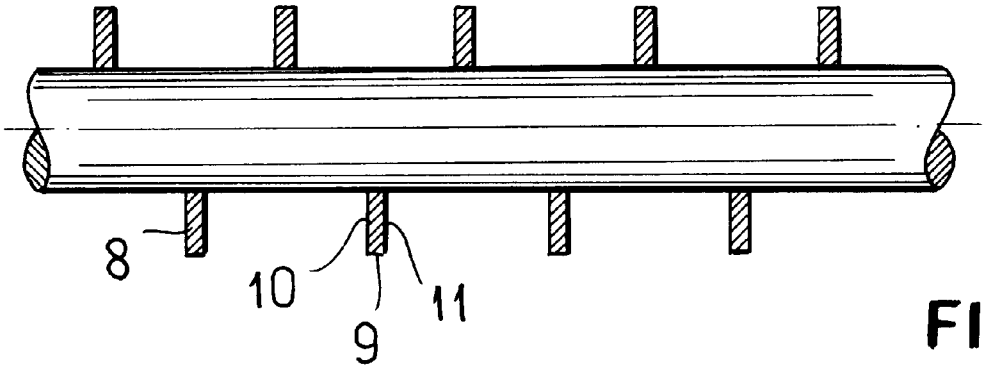
FIG. 5 shows a detail.

As shown in FIG. 1 an endless conveyor belt 1 is spanned over rollers 2 and 3 which are journaled in a stationary machine frame 4. One of the two rollers 2 and 3 is driven. Below the upper stretch of the belt 1 is a support formed by a stable rigid plate 5. On each side of the machine frame 4 is a respective bearing housing 6 for an auger 7 that extends above the upper stretch of the belt 1 over its entire width, here for example 0.65 m. The bearings of the auger 7 are vertically displaceably adjustable in the bearing housing 6 so that the spacing between the belt 1 and the auger 7 can be set exactly. The auger 7 has a right-handed screwthread 8 that is shown in more detail in FIG. 5. The outside screwthread edge 9 lies on an imaginary cylinder coaxial with the auger and forms with the two screwthread flanks 10 and 11 angles of 90°. The auger 7 is connected to a drive 12. Parallel to and flanking the auger 7 upstream and downstream are hold-down rollers 13. The machine frame 4 is provided on both sides with guide elements 14 for continuous panels 15.

The apparatus is preferably integrated into a continuous production line for gypsum-fiber panels. In a system, which includes devices for making rough panels, a binding station, and a dryer following the binding station, they can, as with belt-sanding machines, be downstream of the dryer. The dried panels 15 which have been cut by a saw to standard 2.5 m format run through the apparatus in the direction of arrow 16 one immediately after the other. The hold-down rollers 13 prevent the panels 15 from slipping on the conveyor 1. The bearings of the auger 7 are vertically adjustable such that the spacing between the conveyor belt 1 and the auger 7 corresponds to the desired thickness of the finished smoothed panel. The auger 7 rotates in the direction shown by arrow 17 so that peripheral movement of the auger in the engagement direction is opposite the workpiece movement.

The rotating auger 7 scrapes fine particles from the upper surface of the panel 15 moving underneath itself. These are mainly carried off by the rotation of the auger 7 and drop into a holder that is not shown in the drawing. Only a relatively small portion of the removed material remains on the panel 15 and is subsequently vacuumed up. Dust generation is relatively small compared to a belt-sanding machine. This can be explained by the gravelly structure of the removed material. A further surprising advantage is that the noise level is reduced substantially. The quiet and uniform operation is at least partially thanks to the fact that the auger cuts "on the draw."

It is particularly advantageous when the apparatus according to the invention is installed in a continuous system between the binding station and the dryer. At this location the continuous already stable panels still contain excess water. The original water is normally more than that needed for binding in the necessary stoichiometric quantities in order to improve the workability and optimize crystallization. With the apparatus it is possible, unlike the standard grinding machines whose belts are clogged quickly, to smooth the panels while semirigid in still "half wet" condition. In this situation the apparatus works without generating any dust. A further substantial advantage of this system is that the removed material is not also dried. This saves up to 5% of the energy used for drying.

Figure 3:
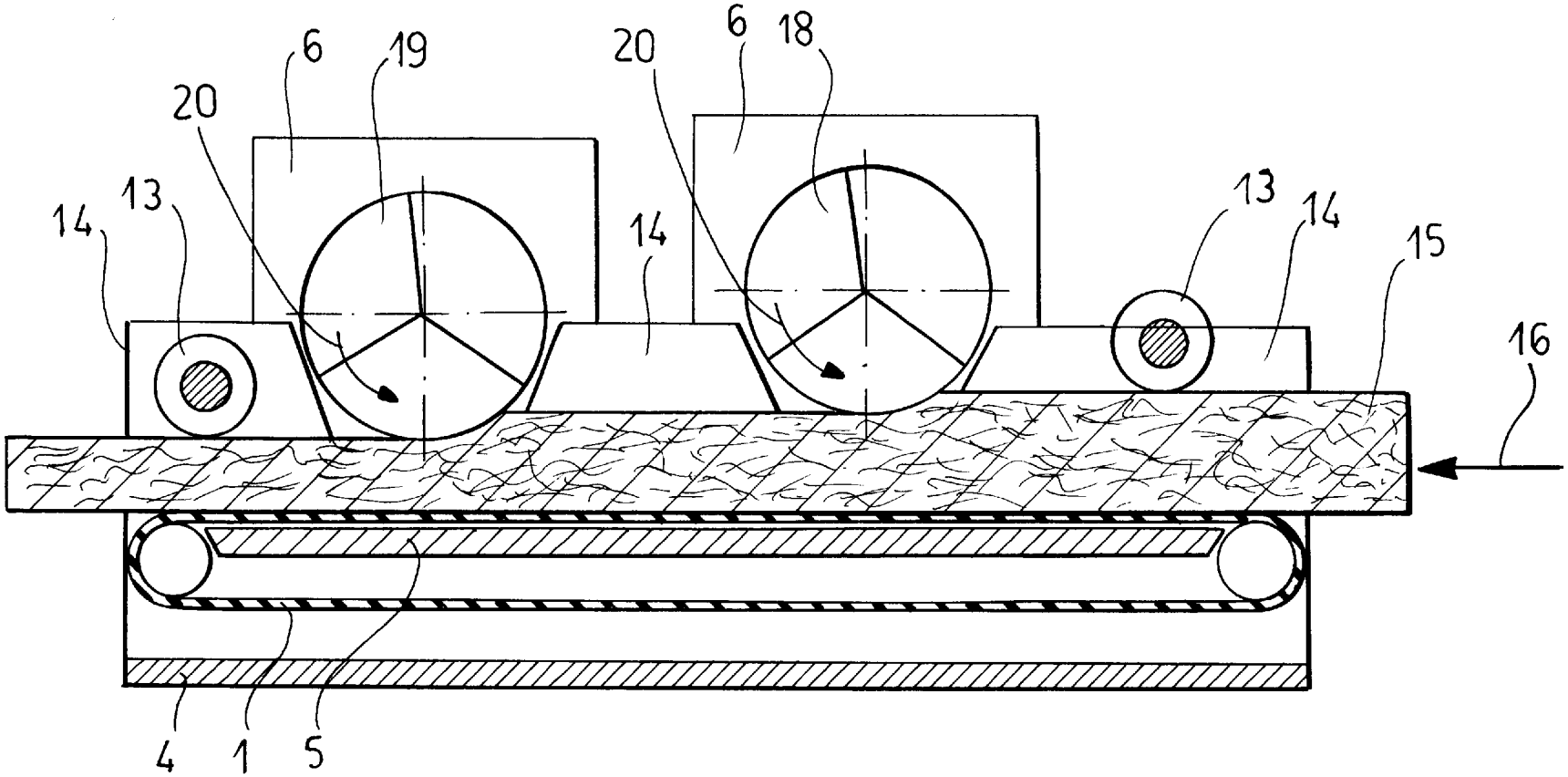
FIG. 3 is a side view of another apparatus according to the invention.
Figure 4:
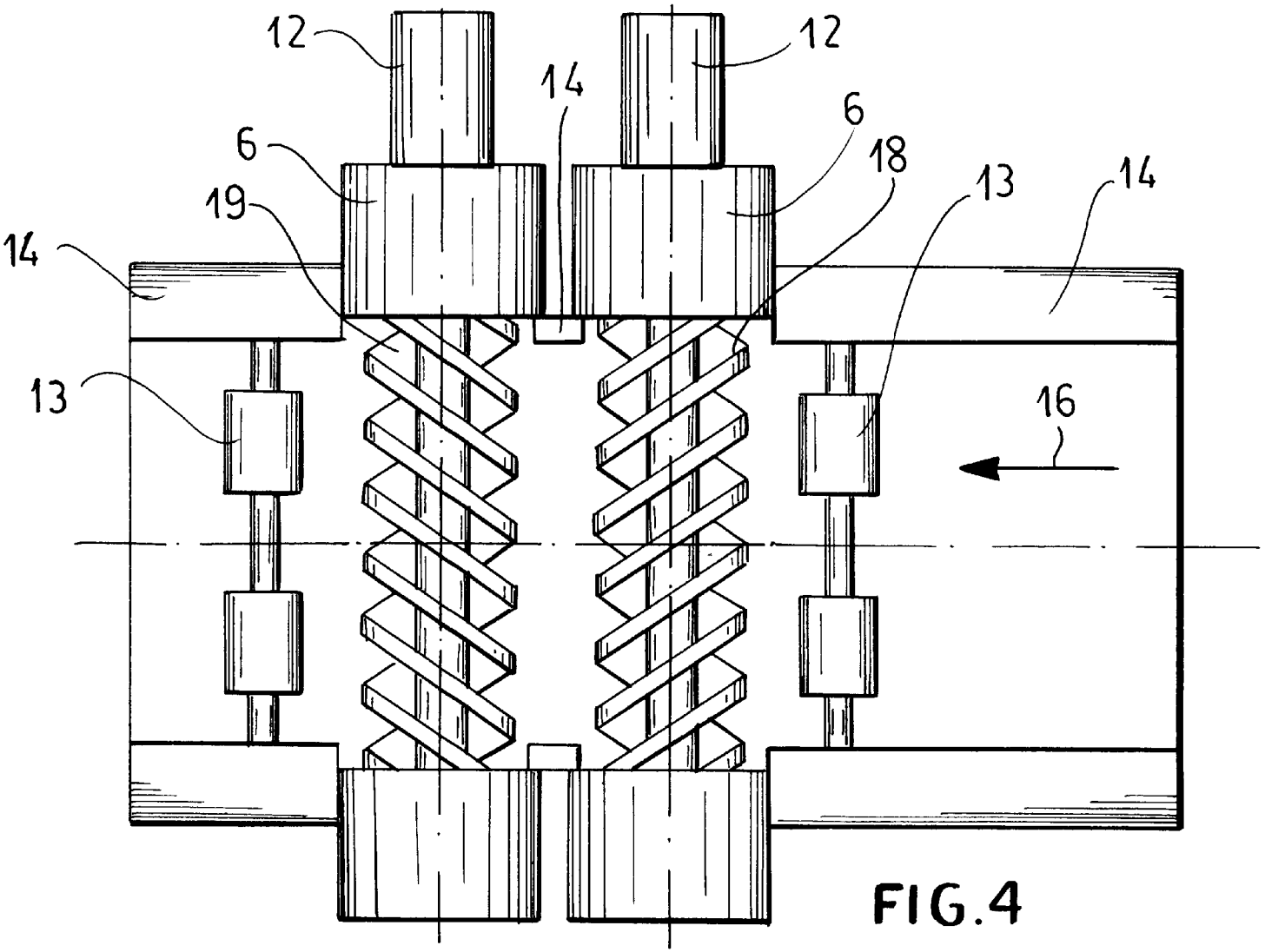
FIG. 4 is a top view of the apparatus according to FIG. 3.

The preferred embodiment shown in FIGS. 3 and 4 is different from the embodiment described up to now in particular in that it has two augers 18 and 19 that are arranged parallel next to each other. Both augers 18 and 19 have three screwthreads. The turns of the auger 18 extend as a right-handed thread and the turns of the auger 19 as a left-handed thread. The two augers 18 and 19 are driven in the same direction as shown by arrows 20. The bearings of the auger 19 are set at such a height that the spacing between the auger 19 and the belt 1 corresponds to the predetermined thickness of the rigid panel. With the auger 18 the spacing is a little greater so that it lies roughly in the middle between the thickness of the rough panel and the thickness of the finished panel. The thickness of the rough panel in the example is about 15 mm and the thickness of the finished panel 14 mm.

As a result of the two augers 18 and 19 at different heights the material is removed in two steps of 0.5 mm each. The two-stage operation makes it possible to make the structure of the smoothed surface even smoother. A further advantage of this embodiment is that the forces exerted transversely to the travel direction by the two augers 18 and 19 on the panel are opposite each other and at least partially compensate for each other. Multithread augers have the advantage that they work very quietly.

Figure 7:
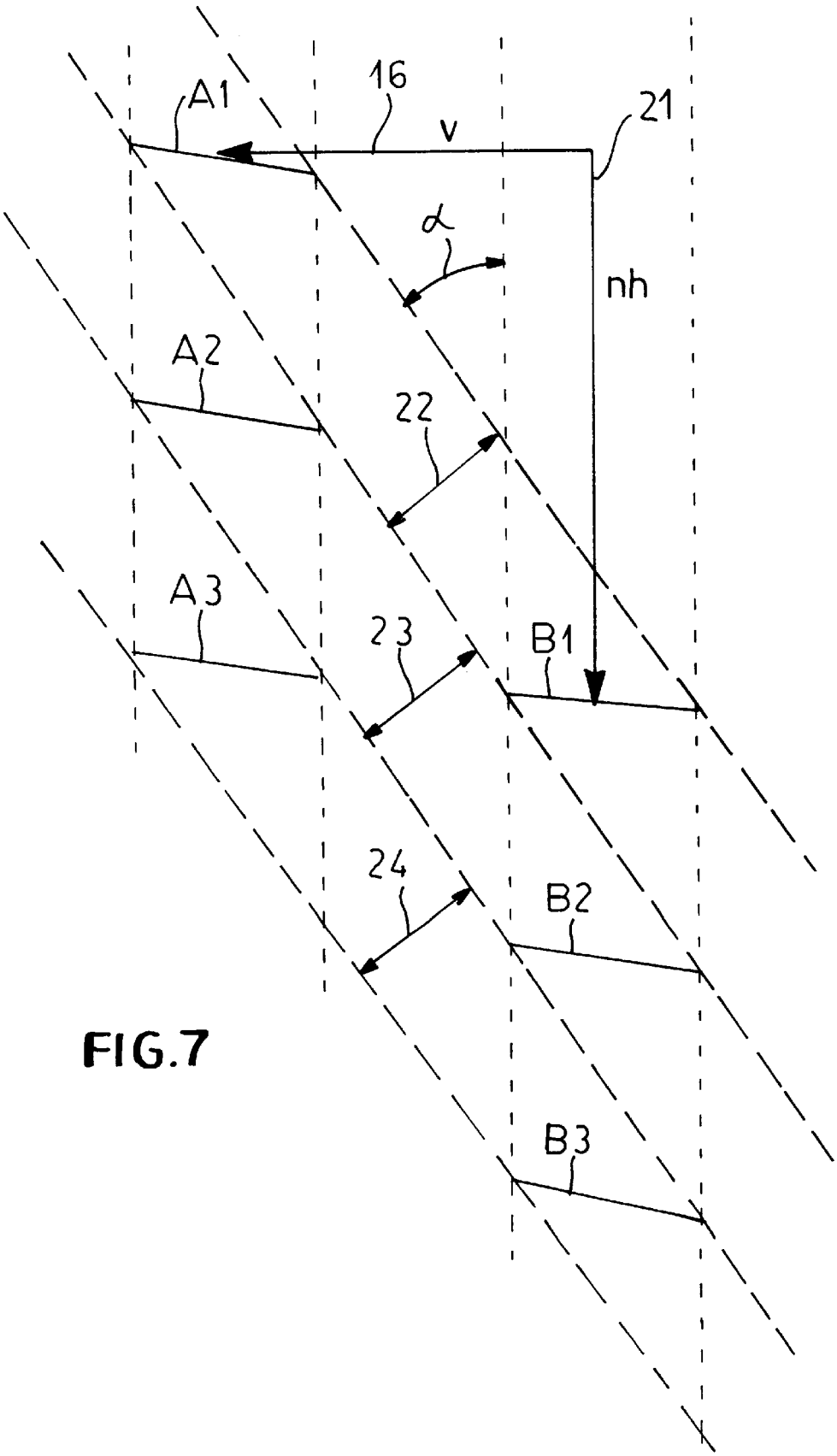
FIG. 7 shows a portion of the upper surface of a panel being machined.

At a particular time according to FIG. 7 three adjacent turns of triple right-angle threaded augers engage the panel at the locations A1, A2, and A3. The panel moves with a speed V in the direction of the arrow 16 while the turns of the clockwise-rotating auger move with an apparent axial speed nh in the direction of arrow 21. Here n is the rotation rate and h the height of the thread. Thus after a certain interval, for example after a full rotation of the auger, the three threads engage at the locations B1, B2, B3. Meanwhile they have cut three flat grooves 22, 23, and 24 into the surface of the panel. The grooves extend at an acute angle. The angle a between the direction in which the angles 22, 23, and 24 extend and a line 25 extending perpendicular to the panel is equal to $$\alpha=\arctan(v/n\cdot h).$$

The width of the individual grooves must be large enough that no spaces are left between adjacent grooves 22, 23, and 24. This can be achieved easily in that the engagement depth t of the auger in the panel is sufficiently great. The necessary minimum dimension for the engagement depth can be determined e.g. by experimentation or calculated based on simple geometric relationships. With the embodiment provided for machining gypsum-fiber panels according to the following table the grooves 22, 23, and 24 adjoin one another as shown in FIG. 7 without gaps.

TABLE 1

| Feature | Symbol | Example |
|---|---|---|
| Travel speed | v | 20 m/min |
| Auger rotation rate | n | 550/min |
| Auger diameter | D | 130 mm |
| Thread height | h | 60 mm |
| No. of auger thread | g | 3 |
| Engagement depth | t | 0.5 mm. |

A uniform pattern of angled flat grooves is characteristic for apparatuses according to the invention which are provided with a single auger. With the embodiment according to FIGS. 3 and 4 with two spaced augers the two augers 18 and 19 produce two overlapping strip patterns whose strips cross each other. The grooves are so flat that the surface is effectively planar.

With a further embodiment not shown in the drawing two augers are also arranged one after the other. Unlike the embodiment of FIGS. 3 and 4 the screwthreads of the two augers have the same inclination, that is the threads of both augers run as a right-hand screwthread or both run as a left-hand screwthread. However the two augers are driven in opposite rotational senses. Thus the contact points of the two augers with the panel, like in the embodiment of FIGS. 3 and 4, run across each other. Thus also with this embodiment there is substantial compensation of the transversely oriented force components. As a result of the opposite rotation directions of the two augers however also the force components extending parallel to the travel direction of the panel are opposite each other. Thus force compensation is also effected in the travel direction.

Figure 6:
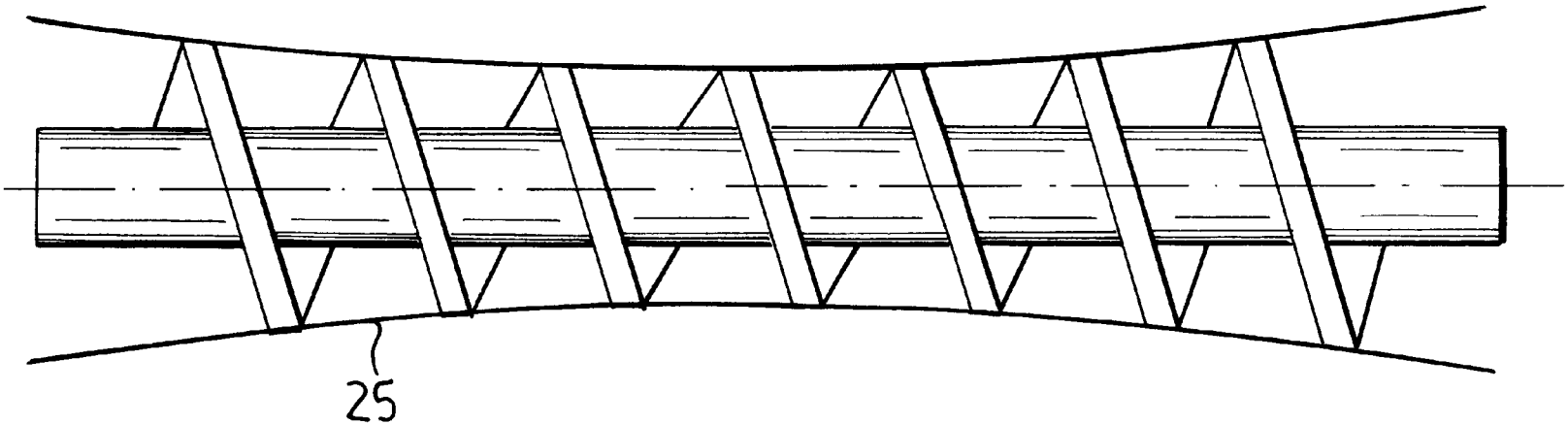
FIG. 6 shows a detail for an alternative embodiment.

The auger shown in FIG. 6 has an outer surface that is not a cylinder. It has for example the shape of a hyperboloid of revolution as shown by solid lines 26. An apparatus according to the invention equipped with one or preferably with several augers of this type spaced in the throughput direction allows one to make panels with curved surfaces. Naturally the shape of the outer surface and the corresponding curvature of the panels can be varied with many shapes.

Figure 10:
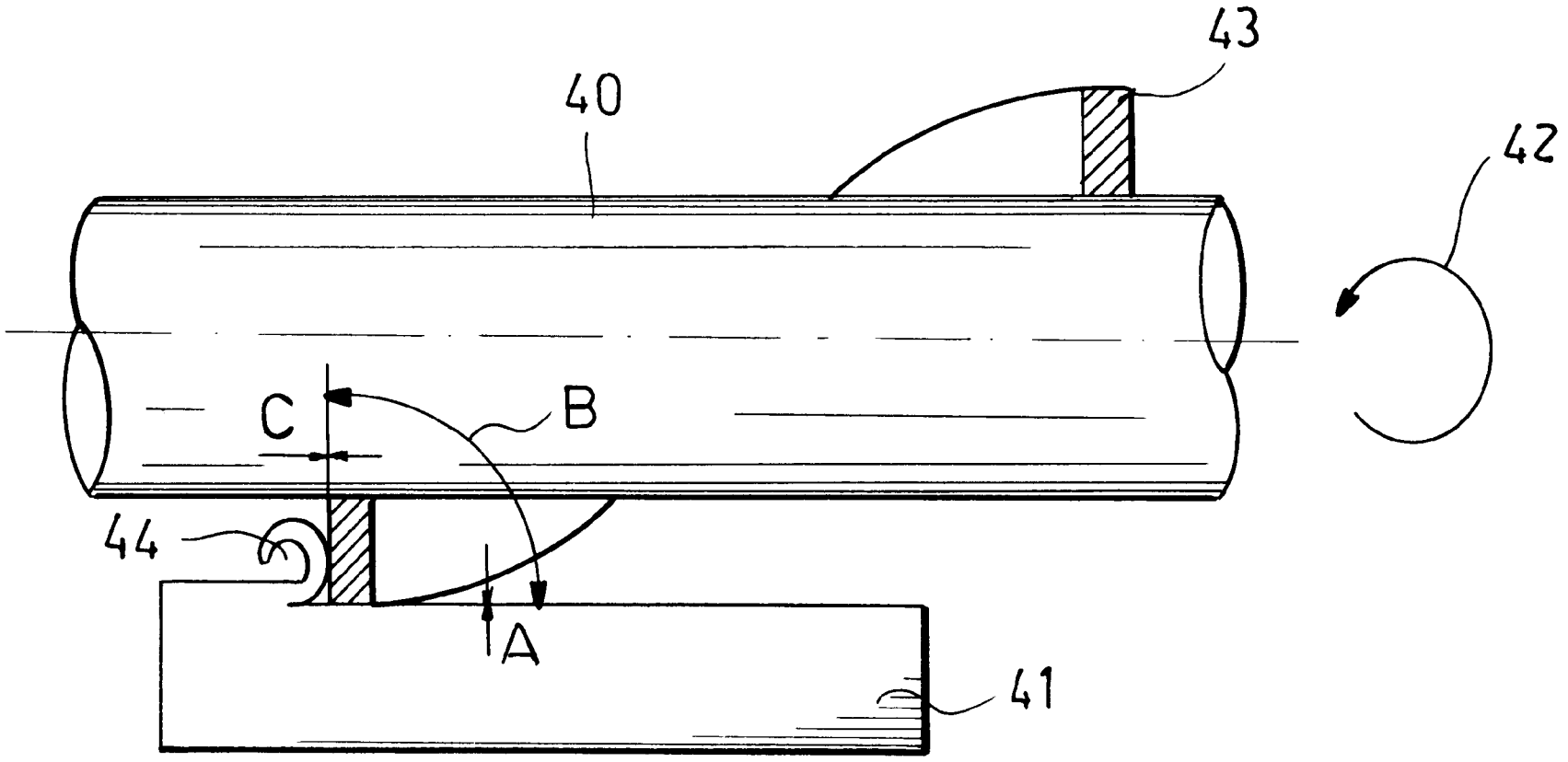
FIG. 10 shows a detail of a preferred embodiment.
Figure 11:
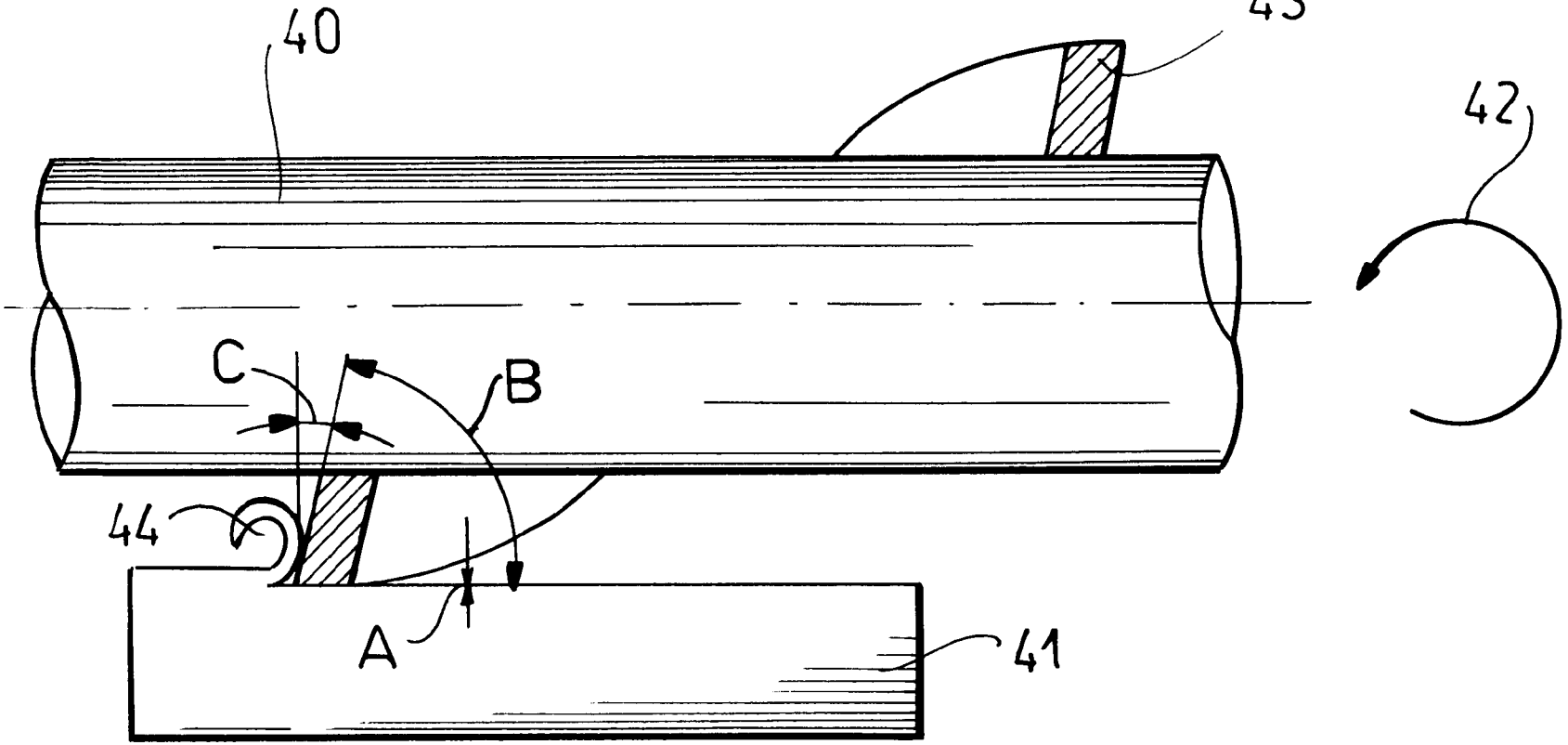
FIG. 11 shows like FIG. 10 a detail of another embodiment.

The cutting geometry is shown for two different embodiments by FIGS. 10 and 11. These two figures show an auger 40 engaged in a workpiece 41. The auger 40 rotates counterclockwise as shown by the arrow 42 seen from the right-hand end. It has a right-handed screwthread 43. The apparent axal movement of the screwthread is therefore directed toward the left. The preferably 2 to 10 mm wide peripheral edge of the screwthread 43 is the so-called free surface. It lies on the cylindrical surface of the auger 40. The angle A between the free surface and the cutting surface, that is the worked surface of the workpiece 41, is the free angle. It amounts according to the invention preferably to 0°. The left flank of the screwthread 43, that is the flank that leads in the direction of apparent axial movement, is the cutting surface over which the chip 44 is guided. The angle B between the free surface and the cutting surface is the cutting angle. It lies according to the invention preferably between 75° and 90°. In the embodiment according to FIG. 10 it is a right angle, the FIG. 11 embodiment has an acute angle of about 80°. Correspondingly the cutting angle C in FIG. 10 is exactly 0° while in FIG. 11 it is 10°. The helical line at which the cutting surface meets the surrounding surface is the cutting edge.

The auger 40 is preferably made of an unalloyed steel, a structural steel. e.g. ST 52.3 or an unalloyed hardened steel that has not been heat treated. e.g. C 45. Such steels have in comparison to unalloyed or alloyed tool steels that are often used for machine tools a relatively low resistance to wear. The free edges that in use are in frictional contact with the cut surface of the workpiece thus wear substantially. This ensures however no change in the cutting geometry. The wear actually serves as a constant honing so that a sharp cutting edge is retained. As a result the service life of the auger is very great. An auger that has e.g. an original diameter of 130 mm only needs to be replaced when its diameter has been reduced to 115 mm. Naturally, the auger must be adjustable with respect to height. Although the auger is for these reasons a self-sharpening tool according to the invention it is recommended to mount on the machine frame a small honing machine not shown in the drawing that can if necessary be guided along the surface of the auger.

Meanwhile tests have shown that the apparatus according to the invention that originally was provided in particular for smoothing gypsum-fiber panels is also usable for the surface treatment of panels or strips of other materials, in particular wood. It has been discovered that with workpieces of soft wood after machining with the apparatus according to the invention the surfaces have a structure that is comparable with that of a brushed wood surface. The softer regions of so-called early wood stand out from the treated surface. This effect is for example for certain applications raised. This effect is for example desired in the furniture industry. With so-called solid wood panels that are glued up from narrow strips the advantage over a standard belt-sanding machine is obtained of not clogging the tool with glue, When multi-thread augers with a large number of screwthreads are used it is possible to achieve considerable material removal with a deep cut since at all times several screwthreads of the auger are working. The following parameter combinations have been found advantageous for the working of solid beech wood:

TABLE 2

| | |
|---|---|
| Travel speed | 4 to 8 m/min |
| Auger rotation rate | 2850/min |
| Auger diameter | 130 mm |
| Thread height | 630 mm |
| No. of auger threads | 9 |
| Engagement depth | 0.5 mm. |
| Screwthread edge width | 3 mm |

Even plywood, fiber board (so-called MDF panels) and panels of various plastics, for instance polyamide and polytetrafluorethylene, have been machined with success.

Figure 8:
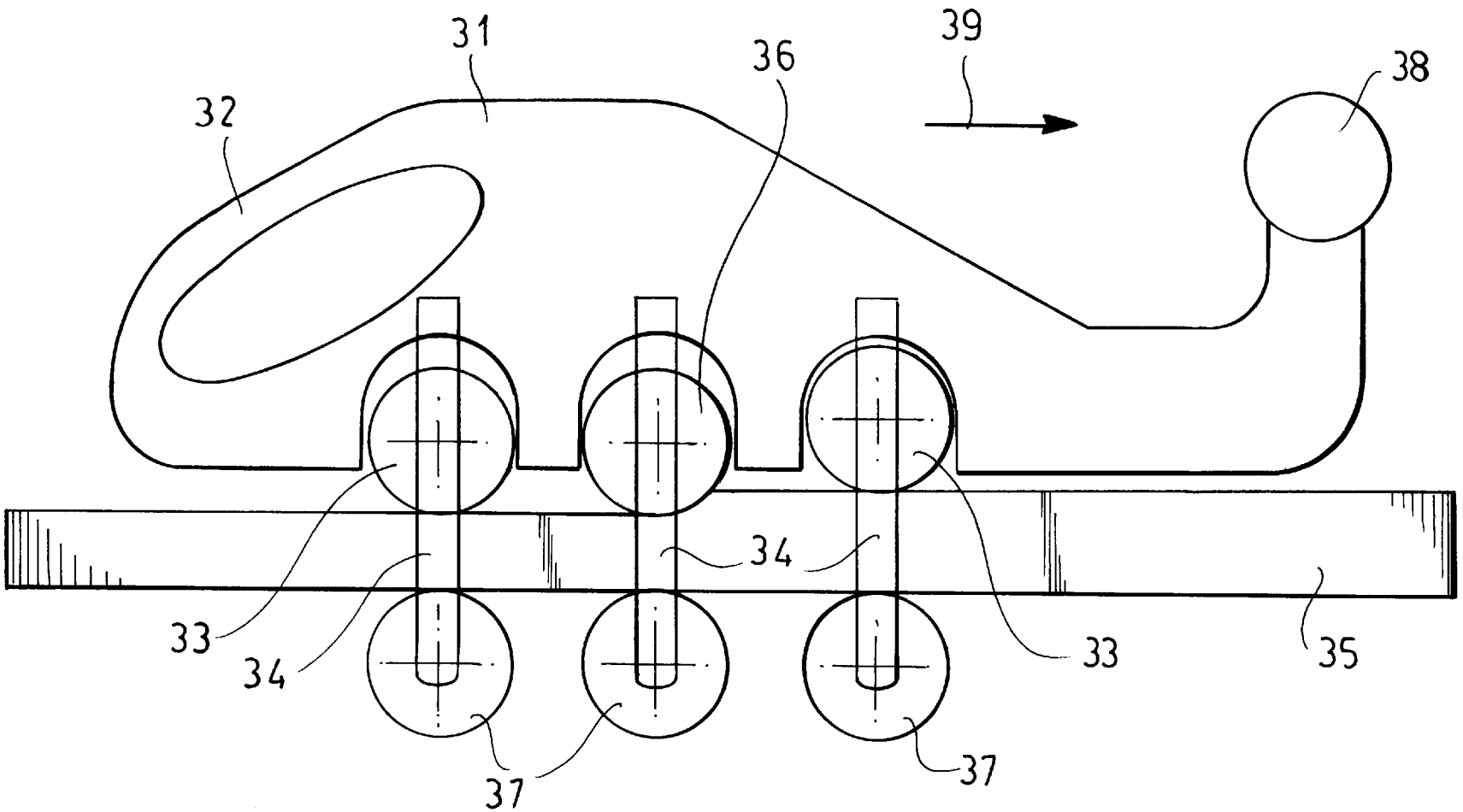
FIG. 8 is a side view of a portable tool.
Figure 9:
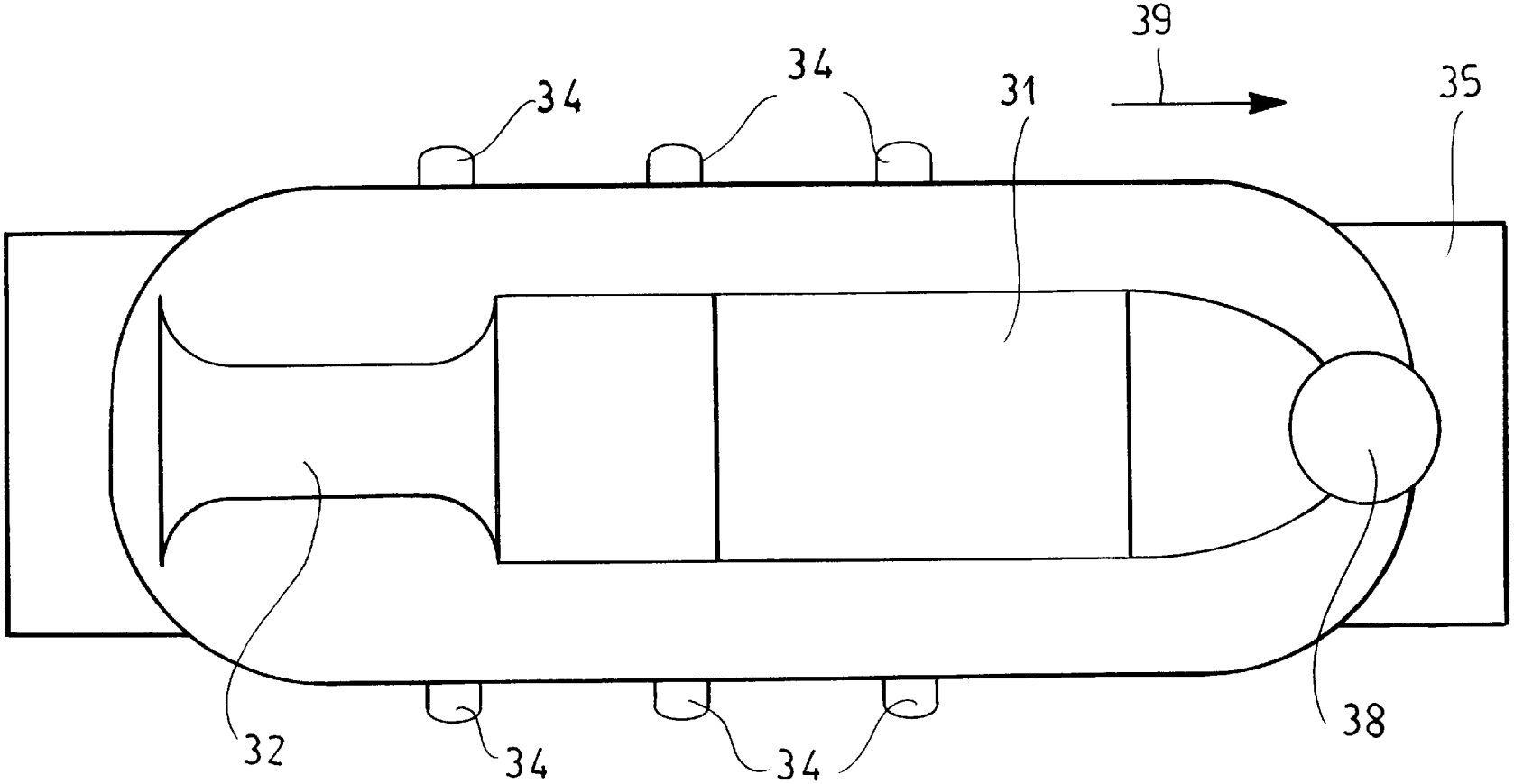
FIG. 9 is a top view of the portable tool.

The portable hand tool shown in FIGS. 8 and 9 is particularly intended for machining wood strips. Three holders 34 are laterally mounted in a row on a housing 31 which has a handle 32 and a knob 38. The middle holder 34 rotatably supports an auger 36 while the two other holders each of about 50 mm. It is rotated by an unillustrated motor at high speed. e.g. 8000 rpm. The two pressure rollers 33 are also driven, each with a lower rotation rate that produces an advance in the direction of arrow 30 of e.g. 4 m/min. They are provided with a covering of rubber or an elastomeric plastic that produces a high coefficient of friction with the material being worked. The two pressure rollers 33 like the auger are received in recesses that are formed in the housing 31 so that they only project partially with a segment from the sole plate of the housing 31. Support rollers 37 are rotatably mounted in the holders 34 spaced from the pressure rollers 33 and the auger 36. The spacing can be adjusted to conform to the thickness of the workpiece 35 being acted on. The support of the two pressure rollers 33 is elastic so that the pressure rollers 33 engage with a variable force on the workpiece. The operation of the portable hand tool is completely analogous to the operation of the stationary apparatus described with reference to FIG. 1 and needs no further description.

I claim:

1. An apparatus for smoothing of continuous gypsum-fiber panels and similar panels, the apparatus comprising:

a frame;

a conveyor on the frame; and at least one rotatable and driven auger extending transversely above the conveyor for removing fine particles of the surface to be smoothed.

2. A portable hand tool for smoothing strips, the hand tool comprising:

a housing;

a row of support rollers spaced from a sole plate of the housing, and at least one rotatably driven auger mounted in the housing parallel to the support rollers and provided with a drive for removing fine particles of a surface of the strip to be smoothed.

3. The apparatus according to claim 1 wherein a plurality of augers are arranged one after the other in the travel direction and the spacing between augers and the conveyor in the travel direction decreases from auger to auger.

4. The apparatus according to claim 2 wherein the augers have multiple threads.

5. The apparatus according to claim 2 wherein augers with right-hand threads and augers with left-hand threads alternate and are driven in the same rotational sense.

6. The apparatus according to claim 2 wherein augers whose threads have the same hand alternate and are driven in opposite directions.

7. The apparatus according to claim 1 wherein the peripheral edge of the screwthread meets each of the flanks at a right angle.

8. The apparatus according to claim 1 wherein the screwthread of each auger has a free angle of 0°.

9. The apparatus according to claim 1 wherein the screwthread of each auger has a cutting angle of 0 to 15°.

10. The apparatus according to claim 1 wherein the augers are formed of an unalloyed steel, in particular structural steel or unalloyed hardened steel that has not been heat treated.

11. The apparatus according to claim 1 wherein the outer surface of the auger varies from a cylindrical shape.

12. An installation for continuously making gypsum-fiber panels, the installation comprising devices for forming rough panels that have a mixture of bindable gypsum, fibers, and stoichiometrically excess amount of water, a binding station for the rough panels, a dryer after the binding station, and an apparatus for smoothing the passing panels between the binding station and the dryer, the apparatus comprising:

a frame;

a conveyor; and at least one rotatable and driven auger extending transversely above the conveyor for removing fine particles of the surface to be smoothed.

13. An apparatus for smoothing a workpiece, the apparatus comprising:

a housing;

means for relatively displacing the housing and the workpiece in a direction;

a pair of augers provided with respective screwthreads having outer edges in contact with the workpiece, the augers being rotatable on the housing about respective generally parallel axes transverse to the direction; and means for rotating the augers about the respective axes and thereby scraping the workpiece with the screwthreads, the augers being of such a hand and the means rotating the augers in such a direction that the augers exert on the workpiece opposite axially directed forces.

14. The apparatus defined in claim 13 wherein the screwthreads are of the same hand and the means rotates the augers oppositely.

15. The apparatus defined in claim 13 wherein the screwthreads are of opposite hand and the means rotates the augers in the same direction.

16. The apparatus defined in claim 13 wherein the augers have multiple screwthreads.

17. The apparatus defined in claim 13 wherein each of the screwthreads has an outer edge extending parallel to the respective axis and a pair of flanks forming angles of 90° with the outer edge.

18. The apparatus defined in claim 13 wherein the augers are unitarily formed with the respective screwthreads of unalloyed steel.

19. The apparatus defined in claim 13 wherein the augers are unitarily formed with the respective screwthreads of non heat-treated steel.

20. The apparatus defined in claim 13 wherein the screwthreads have outer edges lying on respective imaginary cylinders centered on the respective axes.

* * * * *